US009323175B2

(12) United States Patent
Hirai et al.

(10) Patent No.: US 9,323,175 B2
(45) Date of Patent: Apr. 26, 2016

(54) BRILLIANT TONER, ELECTROSTATIC CHARGE IMAGE DEVELOPER, AND TONER CARTRIDGE

(71) Applicant: FUJI XEROX CO., LTD., Tokyo (JP)

(72) Inventors: Sakiko Hirai, Kanagawa (JP); Shotaro Takahashi, Kanagawa (JP); Masaru Takahashi, Kanagawa (JP); Atsushi Sugitate, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/043,319

(22) Filed: Oct. 1, 2013

(65) Prior Publication Data

US 2014/0234765 A1 Aug. 21, 2014

(30) Foreign Application Priority Data

Feb. 21, 2013 (JP) ..... 2013-032484

(51) Int. Cl.

| | |
|---|---|
| ***G03G 9/00*** | (2006.01) |
| ***G03G 15/08*** | (2006.01) |
| ***G03G 9/09*** | (2006.01) |
| *G03G 9/08* | (2006.01) |
| *G03G 9/087* | (2006.01) |

(52) U.S. Cl.

CPC ..... *G03G 15/0865* (2013.01); *G03G 9/0902* (2013.01); *G03G 15/0822* (2013.01); *G03G 9/0819* (2013.01); *G03G 9/08755* (2013.01); *G03G 9/08782* (2013.01); *G03G 9/08795* (2013.01)

(58) Field of Classification Search

CPC ... G03G 9/09; G03G 15/0865; G03G 9/0902; G03G 15/0822; G03G 9/08755; G03G 9/0819; G03G 9/08782; G03G 9/08795

USPC ..... 430/109.4, 123.5, 123.57; 399/252

See application file for complete search history.

(56) References Cited

U.S. PATENT DOCUMENTS

| | | | | |
|---|---|---|---|---|
| 4,518,673 | A * | 5/1985 | Noguchi et al. | 430/109.3 |
| 5,180,650 | A | 1/1993 | Sacripante et al. | |
| 2008/0200560 | A1 * | 8/2008 | Kniess et al. | 514/769 |
| 2011/0318683 | A1 * | 12/2011 | Kadokura et al. | 430/105 |

FOREIGN PATENT DOCUMENTS

| | | | |
|---|---|---|---|
| JP | 54156038 | A | 12/1979 |
| JP | A-5-281779 | | 10/1993 |
| JP | A-2003-012964 | | 1/2003 |
| JP | 2007537353 | A | 12/2007 |
| JP | 2009503207 | A | 1/2009 |
| JP | 2012042624 | A | 3/2012 |
| WO | 2006/118577 | A1 | 11/2006 |
| WO | 2007/017195 | A2 | 2/2007 |

OTHER PUBLICATIONS

Jan. 5, 2016 Office Action issued in Japanese Application No. 2013-032484.

* cited by examiner

*Primary Examiner* — Thorl Chea
(74) *Attorney, Agent, or Firm* — Oliff PLC

(57) ABSTRACT

A brilliant toner includes a metallic pigment, and a Fe content in the brilliant toner is from 0.001% by weight to 2% by weight.

15 Claims, 3 Drawing Sheets

BRILLIANT TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2013-032484 filed Feb. 21, 2013.

BACKGROUND

1. Technical Field

The present invention relates to a brilliant toner, an electrostatic charge image developer, and a toner cartridge.

2. Related Art

Brilliant toners are used for the purpose of forming an image having brightness such as metallic luster.

SUMMARY

According to an aspect of the invention, there is provided a brilliant toner including a metallic pigment, in which a Fe content is from 0.001% by weight to 2% by weight.

BRIEF DESCRIPTION OF THE DRAWINGS

Exemplary embodiments of the present invention will be described in detail based on the following figures, wherein.

DETAILED DESCRIPTION

Hereinafter, exemplary embodiments of a brilliant toner, an electrostatic charge image developer, a toner cartridge, a process cartridge, an image forming apparatus, and an image forming method of the invention will be described in detail.

Brilliant Toner

A brilliant toner according to an exemplary embodiment (hereinafter, may be referred to as the toner according to the exemplary embodiment) includes a metallic pigment and has a Fe content of from 0.001% by weight to 2% by weight.

In this exemplary embodiment, "brilliance" indicates that an image formed from the brilliant toner according to this exemplary embodiment has brightness such as metallic luster, when being visually confirmed.

A reduction in brilliance of a brilliant image by discoloration is prevented by using the toner according to this exemplary embodiment. The reason for this is not clear, but is presumed as follows.

As a cause of discoloration of a brilliant image, a deterioration of a binder resin resulting from active oxygen or oxidation of a metallic pigment included in the brilliant image is exemplified.

Figure 1:
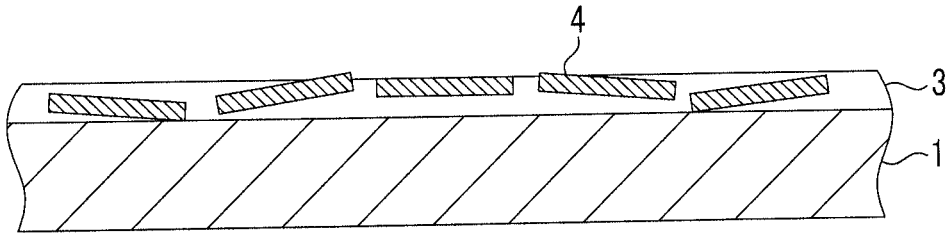
FIG. 1 is a diagram for illustrating a fixing state of a brilliant image fixed to a surface of a recording medium.

FIG. 1 is a diagram for illustrating a fixing state of a brilliant image fixed to a surface of a recording medium. In FIG. 1, a brilliant image 3 fixed to a surface of a recording medium 1 includes a flake-shape metallic pigment 4. The metallic pigment 4 may be exposed from a surface of the brilliant image 3. The metallic pigment 4 that is exposed from the surface of the brilliant image 3 is oxidized and becomes discolored due to the influence of moisture in the air and the like. As a result, a reduction occurs in the brilliance of the brilliant image.

The toner according to this exemplary embodiment includes a specific Fe amount. Fe is easily oxidized, and when its amount is small, Fe may not be perceived even when being visually observed. Since Fe is more easily oxidized than the metallic pigment, the oxidation of the metallic pigment and the deterioration of the binder resin may be prevented. As a result, it is presumed that discoloration of the brilliant image is prevented.

In the toner according to this exemplary embodiment, the Fe content is from 0.001% by weight to 2% by weight. When the Fe content is greater than 2% by weight, ions may effuse at high humidity and image deletion may occur due to the reason such as a reduction in charging amount of the toner. On the other hand, when the Fe content is less than 0.001% by weight, the oxidation of the metallic pigment and the deterioration of the binder resin may not be prevented by Fe.

The Fe content in the toner according to this exemplary embodiment is preferably from 0.005% by weight to 1% by weight, and more preferably from 0.01% by weight to 0.5% by weight.

The origin of Fe contained in the toner according to this exemplary embodiment is not particularly limited. However, separately from the metallic pigment, a Fe-containing component may be contained in the toner, or a Fe-containing metallic pigment may be used.

In this exemplary embodiment, the Fe content is a value that is measured by fluorescent X-ray analysis (XRF). The conditions for the measurement by XRF and a measurement sample preparation method will be described later.

In the toner according to this exemplary embodiment, the Fe content in the surface that is measured by an X-ray photoelectron spectrometer (XPS) is preferably from 0.0005% by weight to 2% by weight, more preferably from 0.005% by weight to 1% by weight, and particularly preferably from 0.01% by weight to 0.5% by weight. When the Fe content in the toner surface is from 0.0005% by weight to 2% by weight, discoloration of the brilliant image is further prevented.

In this exemplary embodiment, the conditions for the measurement by the X-ray photoelectron spectrometer (XPS) are will be described later.

As for the toner according to this exemplary embodiment, when a solid image is formed, a ratio (A/B) of a reflectance A at a light-receiving angle of +30° to a reflectance B at a light-receiving angle of −30°, that are measured when the image is irradiated with incident light at an incident angle of −45° by a goniophotometer, is preferably from 2 to 100.

The phenomenon that the ratio (A/B) is 2 or greater indicates that reflection on aside (plus-angle side) opposite to a side (minus-angle side) on which the incident light is radiated is larger than reflection on the side (minus-angle side) on which the incident light is radiated, that is, diffuse reflection of the incident light is suppressed. When diffuse reflection in which incident light is reflected in various directions occurs and the reflected light is visually confirmed, colors appear to be dull. Therefore, when the ratio (A/B) is less than 2, even when the reflected light is visually confirmed, the gloss may not be confirmed and the brilliance may become poor.

On the other hand, when the ratio (A/B) is greater than 100, an angle of view at which the reflected light is visible is too narrow and a regular-reflection light component is large. As a result, an image may be viewed as a dark image depending on the angle of view. In addition, it is difficult to manufacture a toner having a ratio (A/B) that is greater than 100.

The ratio (A/B) is more preferably from 50 to 100, even more preferably from 60 to 90, and particularly preferably from 70 to 80.

Measurement of Ratio (A/B) by Goniophotometer

First, the incident angle and the light-receiving angle will be described. In this exemplary embodiment, the incident angle is set to −45° in the measurement by a goniophotometer. This is because high measurement sensitivity is achieved for images having a wide range of glossiness.

In addition, the reason why the light-receiving angle is set to −30° and +30° is that the highest measurement sensitivity is achieved in the evaluation of brilliant images and non-brilliant images.

Next, a method of measuring the ratio (A/B) will be described.

In this exemplary embodiment, in the measurement of the ratio (A/B), first, a "solid image" is formed by the following method. A developing device of a DocuCentre-III C7600 manufactured by Fuji Xerox Co., Ltd. is filled with a developer that is a sample, and a solid image having a toner amount of 4.5 g/cm$^2$ is formed on a recording sheet (OK Top Coat+ paper, manufactured by Oji Paper Co., Ltd.) at a fixing temperature of 190° C. and a fixing pressure of 4.0 kg/cm$^2$. The "solid image" refers to an image having a coverage rate of 100%.

Incident light at an incident angle of −45° is radiated on an image part of the formed solid image by using a spectral varied angle color-difference meter GC5000L as a goniophotometer manufactured by Nippon Denshoku Industries Co., Ltd., and a reflectance A at a light-receiving angle of +30° and a reflectance B at a light-receiving angle of −30° are measured. Each of the reflectance A and the reflectance B is measured for light having a wavelength of from 400 nm to 700 nm at intervals of 20 nm, and defined as an average of the reflectances at respective wavelengths. The ratio (A/B) is calculated from these measurement results.

Configuration of Toner

From the viewpoint of satisfying the above-described ratio (A/B), the toner according to this exemplary embodiment preferably satisfies the following requirements (1) and (2).

(1) The toner has an average equivalent circle diameter D longer than an average maximum thickness C.

(2) When cross sections of toner particles in a thickness direction are observed, the number of metallic pigment particles that are present so that an angle between a long axis direction of the toner in the cross section and a long axis direction of the metallic pigment is from −30° to +30° is 60% or greater of the total number of metallic pigment particles that are observed.

Figure 2:
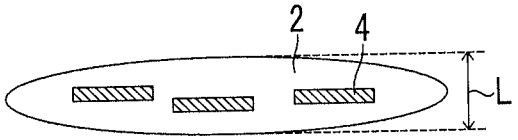
FIG. 2 is a cross-sectional view schematically showing a toner according to an exemplary embodiment.

FIG. 2 shows a cross-sectional view schematically showing a toner satisfying the above-described requirements (1) and (2). The schematic view shown in FIG. 2 is a cross-sectional view of the toner in a thickness direction thereof.

A toner 2 shown in FIG. 2 is a flake-shape toner having an equivalent circle diameter larger than a thickness L, and contains a metallic pigment 4, each particle having a flake-like shape.

In the case in which the toner 2 has a flake shape in which the equivalent circle diameter is larger than the thickness L as shown in FIG. 2, when the toner is moved to an image holding member, an intermediate transfer member, a recording medium, or the like in a developing step or a transfer step in the image formation, the toner tends to move so as to cancel out the charges of the toner to the maximum extent. Therefore, it is thought that the toner particles are arranged so that the adhering area becomes the maximum. That is, it is thought that the flake-shape toner particles are arranged so that the flat surface side thereof faces a surface of a recording medium onto which the toner is finally transferred. In addition, in a fixing step in the image formation, it is thought that the flake-shape toner particles are also arranged by the pressure during fixing so that the flat surface side thereof faces the surface of the recording medium.

Therefore, among the flake-shape metallic pigment particles contained in the toner, metallic pigment particles that satisfy "an angle between a long axis direction of the toner in the cross section and a long axis direction of the metallic pigment is from −30° to +30°" described in the requirement (2) are thought to be arranged so that the surface side that provides the maximum area faces the surface of the recording medium. It is thought that, when an image formed in this manner is irradiated with light, the proportion of a metallic pigment that causes diffuse reflection of the incident light is suppressed, and thus the above-described range of the ratio (A/B) is achieved. In addition, when the proportion of the metallic pigment that causes diffuse reflection of the incident light is suppressed, the intensity of the reflected light remarkably varies depending on the angle of view, and thus more ideal brilliance is obtained.

Next, components of the toner according to this exemplary embodiment will be described.

The toner according to this exemplary embodiment is configured to include toner particles, and if necessary, an external additive.

The toner particles are configured to include, for example, a binder resin, a metallic pigment, and if necessary, a release agent and other additives.

Metallic Pigment

As the metallic pigment that is used in this exemplary embodiment, for example, the following pigments are used. Metal powders such as an aluminum powder, a brass powder, a bronze powder, a nickel powder, and a zinc powder are exemplified.

Among these, from the viewpoint of availability and ease of obtaining a flake shape, an aluminum (Al)-containing pigment is preferable as the metallic pigment that is used in this exemplary embodiment.

When an Al-containing pigment is used as the metallic pigment, the Al content in the metallic pigment is preferably from 40% by weight to 100% by weight, and more preferably from 60% by weight to 98% by weight.

The metallic pigment that is used in this exemplary embodiment may also contain Fe other than Al. Regarding the content ratio (based on weight) between Al and Fe in the metallic pigment, Fe is preferably from 0% by weight to 5% by weight, and more preferably from 0.001% by weight to 2% by weight with respect to Al. The Fe content in the metallic pigment is measured by XRF.

The metallic pigment that is used in this exemplary embodiment may be surface-coated with a Fe-containing layer. When the surface of the metallic pigment is coated with a Fe-containing layer, the Fe-containing layer acts as a film, and thus the metallic pigment is difficult to be oxidized and occurrence of image unevenness is prevented.

The thickness of the Fe-containing layer that is coated on the surface of the metallic pigment is preferably from 5 nm to 500 nm, and more preferably from 10 nm to 200 nm.

The following method is exemplified as a method of coating the surface of the metallic pigment with the Fe-containing layer.

A metallic pigment and a 10% iron chloride aqueous solution are mixed with each other, and this mixture is stirred for a constant time at 25° C. to uniformly attach iron chloride to the surface of the metallic pigment. The obtained material is filtered, and then vacuum-dried, thereby obtaining an iron-coated metallic pigment.

In the toner according to this exemplary embodiment, the content of the metallic pigment is preferably from 1 part by weight to 70 parts by weight, and more preferably from 5 parts by weight to 50 parts by weight with respect to 100 parts by weight of a binder resin to be described.

Binder Resin

Examples of the binder resin include vinyl resins formed of homopolymers of monomers such as styrenes (e.g., styrene, p-chlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene and butadiene), or copolymers obtained by combining two or more kinds of these monomers.

As the binder resin, there are also exemplified non-vinyl resins such as epoxy resins, polyester resins, polyurethane resins, polyamide resins, cellulose resins, polyether resins, and modified rosin, mixtures thereof with the above-described vinyl resins, or graft polymers obtained by polymerizing a vinyl monomer with the coexistence of such non-vinyl resins.

These binder resins may be used singly or in combination of two or more kinds thereof.

A polyester resin is suitable as the binder resin.

As the polyester resin, a known polyester resin is exemplified.

As the polyester resin, a condensation polymer of a polyvalent carboxylic acid and a polyol is exemplified. A commercially available product or a synthesized product may be used as an amorphous polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferable as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used singly or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic diols and alicyclic diols are preferable, and aromatic diols are more preferable as the polyol.

As the polyol, a tri- or higher-valent polyol employing a crosslinked structure or a branched structure may be used in combination together with diol. Examples of the tri- or higher-valent polyol include glycerin, trimethylolpropane, and pentaerythritol.

The polyols may be used singly or in combination of two or more kinds thereof.

The glass transition temperature (Tg) of the polyester resin is preferably from 50° C. to 80° C., and more preferably from 50° C. to 65° C.

The glass transition temperature is obtained from a DSC curve obtained by differential scanning calorimetry (DSC). More specifically, the glass transition temperature is obtained from "extrapolated glass transition onset temperature" described in the method of obtaining a glass transition temperature in JIS K-1987 "testing methods for transition temperatures of plastics".

The weight-average molecular weight (Mw) of the polyester resin is preferably from 5,000 to 1,000,000, and more preferably from 7,000 to 500,000.

The number-average molecular weight (Mn) of the polyester resin is preferably from 2,000 to 100,000.

The molecular weight distribution Mw/Mn of the polyester resin is preferably from 1.5 to 100, and more preferably from 2 to 60.

The weight-average molecular weight and the number-average molecular weight are measured by gel permeation chromatography (GPC). The molecular weight measurement by GPC is performed using HLC-8120, which is GPC manufactured by Tosoh Corporation as a measuring device, TSK gel Super HM-M (15 cm) which is a column manufactured by Tosoh Corporation, and a THF solvent. The weight-average molecular weight and the number-average molecular weight are calculated using a molecular weight calibration curve plotted from a monodisperse polystyrene standard sample from the results of the above measurement.

A known manufacturing method is used to manufacture the polyester resin. Specific examples thereof include a method of conducting a reaction at a polymerization temperature set to from 180° C. to 230° C., if necessary, under reduced pressure in the reaction system, while removing water or an alcohol that is generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the main component.

The content of the binder resin is, for example, preferably from 40% by weight to 95% by weight, more preferably from 50% by weight to 90% by weight, and even more preferably from 60% by weight to 85% by weight with respect to the entire toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

The melting temperature is obtained from "melting peak temperature" described in the method of obtaining a melting temperature in JIS K-1987 "testing methods for transition temperatures of plastics", from a DSC curve obtained by differential scanning calorimetry (DSC).

The content of the release agent is, for example, preferably from 1% by weight to 20% by weight, and more preferably from 5% by weight to 15% by weight with respect to the entire toner particles.

Other Additives

Examples of other additives include known additives such as a magnetic material, a charge-controlling agent, and an inorganic powder. The toner particles include these additives as internal additives.

In this exemplary embodiment, when the toner contains a Fe-containing component separately from the metallic pigment, iron chloride, iron nitrate, or the like is exemplified as the Fe-containing component.

Characteristics of Toner

Average Maximum Thickness C and Average Equivalent Circle Diameter D

As shown in the requirement (1), the toner according to this exemplary embodiment preferably has an average equivalent circle diameter D larger than an average maximum thickness C. A ratio (C/D) of the average maximum thickness C to the average equivalent circle diameter D is more preferably from 0.001 to 0.500, even more preferably from 0.010 to 0.200, and particularly preferably from 0.050 to 0.100.

When the ratio (C/D) is 0.001 or greater, toner strength is secured and a fracture that is caused due to a stress in the image formation is thus prevented, whereby a reduction in charges that is caused by exposure of the pigment, and fogging that is caused as a result thereof are prevented. On the other hand, when the ratio (C/D) is 0.500 or less, excellent brilliance is obtained.

The average maximum thickness C and the average equivalent circle diameter D are measured by the following method.

A toner is placed on a smooth surface and uniformly dispersed by applying vibrations. 1,000 toner particles are observed with a color laser microscope "VK-9700" (manufactured by Keyence Corporation) at a magnification of 1,000 times to measure a maximum thickness C and an equivalent circle diameter D of a surface viewed from the top, and arithmetic averages thereof are obtained to calculate the average maximum thickness C and the average equivalent circle diameter D.

Angle between Long Axis Direction of Toner in Cross Section and Long Axis Direction of Metallic Pigment As shown in the requirement (2), when cross sections of toner particles in a thickness direction are observed, the number of metallic pigment particles that are present so that an angle between a long axis direction of the toner in the cross section and a long axis direction of the metallic pigment is from −30° to +30° is preferably 60% or greater of the total number of metallic pigment particles that are observed. Furthermore, the number is more preferably from 70% to 95%, and particularly preferably from 80% to 90% of the total number of metallic pigment particles.

When the above number is 60% or greater of the total number of metallic pigment particles, excellent brilliance is obtained.

Here, a method of observing cross sections of toner particles will be described.

Toner particles are embedded using a bisphenol A-type liquid epoxy resin and a curing agent, and a sample for cutting is then prepared. Next, the sample for cutting is cut at −100° C. by using a cutting machine (in this exemplary embodiment, by using a LEICA ultramicrotome (manufactured by Hitachi High-Technologies Corporation)) using a diamond knife to prepare a sample for observation. The sample for observation is observed with a transmission electron microscope (TEM) at a magnification of about 5,000 times to observe cross sections of the toner particles. As for the observed 1,000 toner particles, the number of metallic pigment particles that are present so that the angle between the long axis direction of the toner in the cross section and the long axis direction of the metallic pigment is from −30° to +30° is counted using image analysis software, and the proportion thereof is calculated.

The "long axis direction of the toner in the cross section" indicates a direction perpendicular to the thickness direction of the toner having an average equivalent circle diameter D larger than an average maximum thickness C. The "long axis direction of the metallic pigment" indicates a length direction of the metallic pigment.

The volume average particle size of the toner according to this exemplary embodiment is preferably from 1 μm to 30 μm, and more preferably from 3 μm to 20 μm.

Regarding the volume average particle size $D_{50v}$, cumulative distributions by volume and by number are drawn from the side of the smallest diameter on the basis of particle size ranges (channels) separated based on the particle size distribution measured by a measuring machine such as a Multisizer II (manufactured by Beckman Coulter Inc.). The particle size when the cumulative percentage becomes 16% is defined as that corresponding to a volume $D_{16v}$ and a number $D_{16p}$. The particle size when the cumulative percentage becomes 50% is defined as that corresponding to a volume $D_{50v}$ and a number $D_{50p}$, and the particle size when the cumulative percentage becomes 84% is defined as that corresponding to a volume $D_{84v}$ and a number $D_{84p}$. Using these, a volume average particle size distribution index (GSDv) is calculated as $(D_{84v}/D_{16v})^{1/2}$.

The toner according to this exemplary embodiment may be prepared by adding an external additive to toner particles after manufacturing of the toner particles.

The method of manufacturing toner particles is not particularly limited, and toner particles are prepared by a known method such as a dry method, e.g., a kneading and pulverizing method or a wet method, e.g., an emulsion aggregating method and a melt and suspension method.

The kneading and pulverizing method is a method in which respective materials such as a metallic pigment are mixed, and then melted and kneaded using a kneader, an extruder, or the like to obtain a melted and kneaded material, and the obtained material is coarsely pulverized and then finely pulverized by a jet mill or the like to obtain toner particles having a target particle size using a wind classifier.

More specifically, the kneading and pulverizing method is divided into a kneading step of kneading a toner forming material containing a metallic pigment and a binder resin and a pulverizing step of pulverizing the kneaded material. If necessary, the kneading and pulverizing method may have other steps, such as a cooling step of cooling the kneaded material formed by the kneading step.

The respective steps of the kneading and pulverizing method will be described in detail.

Kneading Step

In the kneading step, a toner forming material containing a metallic pigment and a binder resin is kneaded.

In the kneading step, from 0.5 part by weight to 5 parts by weight of an aqueous medium (e.g., water such as distilled water or ion exchange water, alcohol, or the like) is preferably added with respect to 100 parts by weight of the toner forming material.

Examples of a kneader that is used in the kneading step include a single-axis extruder and a two-axis extruder. Hereinafter, as an example of the kneader, a kneader having a sending screw portion and two kneading portions will be described using a diagram, but the example of the kneader is not limited thereto.

Figure 3:
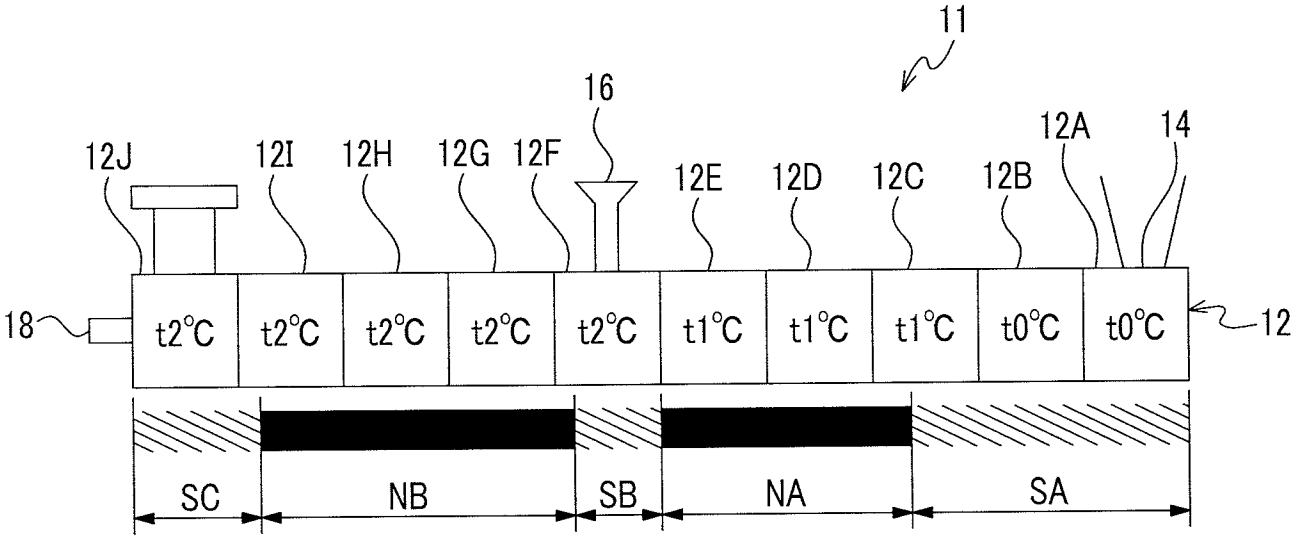
FIG. 3 is a diagram illustrating a screw state of an example of a screw extruder that is used in the manufacturing of the toner according to the exemplary embodiment.

FIG. 3 is a diagram illustrating a screw state of an example of a screw extruder that is used in the kneading step of the method of manufacturing the toner according to this exemplary embodiment.

A screw extruder 11 is constituted by a barrel 12 provided with a screw (not shown), an injection port 14 through which a toner forming material that is a raw material of the toner is injected to the barrel 12, a liquid addition port 16 for adding an aqueous medium to the toner forming material in the barrel 12, and a discharge port 18 through which the kneaded material formed by kneading the toner forming material in the barrel 12 is discharged.

The barrel 12 is divided into, in ascending order of distance from the injection port 14, a sending screw portion SA that transports a toner forming material injected from the injection port 14 to a kneading portion NA, the kneading portion NA for melting and kneading the toner forming material through a first kneading step, a sending screw portion SB that transports the toner forming material melted and kneaded in the kneading portion NA to a kneading portion NB, the kneading portion NB that melts and kneads the toner forming material through a second kneading step to forma kneaded material, and a sending screw portion SC that transports the formed kneaded material to the discharge port 18.

In addition, in the barrel 12, a different temperature controller (not shown) is provided for each block. That is, the temperatures of blocks 12A to 12J may be controlled to be different from each other. FIG. 3 shows a state in which the temperatures of the blocks 12A and 12B are controlled to t0° C., the temperatures of the blocks 12C to 12E are controlled to t1° C., and the temperatures of the blocks 12F to 12J are controlled to t2° C. Therefore, the toner forming material in the kneading portion NA is heated to t1° C., and the toner forming material in the kneading portion NB is heated to t2° C.

When the toner forming material containing a binder resin, a metallic pigment, and if necessary, a release agent and the like is supplied to the barrel 12 from the injection port 14, the sending screw portion SA sends the toner forming material to the kneading portion NA. At this time, since the temperature of the block 12C is set to t1° C., the toner forming material melted by heating is fed to the kneading portion NA. In addition, since the temperatures of the blocks 12D and 12E are also set to t1° C., the toner forming material is melted and kneaded at a temperature of t1° C. in the kneading portion NA. The binder resin and the release agent are melted in the kneading portion NA and subjected to shear by the screw.

Next, the toner forming material kneaded in the kneading portion NA is sent to the kneading portion NB by the sending screw portion SB.

In the sending screw portion SB, an aqueous medium is added to the toner forming material by injecting the aqueous medium to the barrel 12 from the liquid addition port 16. In FIG. 3, the aqueous medium is injected in the sending screw portion SB, but the invention is not limited thereto. The aqueous medium may be injected in the kneading portion NB, or may be injected in both of the sending screw portion SB and the kneading portion NB. That is, the position at which the aqueous medium is injected and the place of injection are selected as necessary.

As described above, due to the injection of the aqueous medium to the barrel 12 from the liquid addition port 16, the toner forming material in the barrel 12 and the aqueous medium are mixed, and the toner forming material is cooled by evaporative latent heat of the aqueous medium, whereby the temperature of the toner forming material is maintained.

Finally, the kneaded material formed by melting and kneading by the kneading portion NB is transported to the discharge port 18 by the sending screw portion SC, and is discharged from the discharge port 18.

The kneading step using the screw extruder 11 shown in FIG. 3 is performed as described above.

Cooling Step

The cooling step is a step of cooling the kneaded material that is formed in the kneading step, and in the cooling step, the kneaded material is preferably cooled to 40° C. or lower from the temperature of the kneaded material upon the end of the kneading step at an average temperature decrease rate of 4° C./sec or higher. In some cases, when the cooling rate of the kneaded material is low, the mixture (mixture with the metallic pigment, and if necessary, an internal additive such as a release agent to be internally added into toner particles) finely dispersed in the binder resin in the kneading step is recrystallized and the dispersion diameter increases. Since the dispersion state immediately after the end of the kneading step is maintained as it is, the kneaded material is preferably rapidly cooled at the average temperature decrease rate. The average temperature decrease rate is an average value of the rate at which the temperature is decreased to 40° C. from the temperature of the kneaded material upon the end of the kneading step (for example, t2° C. when the screw extruder 11 of FIG. 3 is used).

Specific examples of the cooling method in the cooling step include a method using a mill roll with cold water or brine circulated therein and a method using an insertion-type cooling belt. When the cooling is performed using the above-described method, the cooling rate is determined by the speed of the mill roll, the flow rate of the brine, the supply amount of the kneaded material, the slab thickness at the time of rolling of the kneaded material, and the like. The slab thickness is preferably from 1 mm to 3 mm.

Pulverizing Step

The kneaded material cooled through the cooling step is pulverized through the pulverizing step to form toner particles. In the pulverizing step, for example, a mechanical pulverizer, a jet pulverizer or the like is used.

Classification Step

If necessary, the toner particles obtained through the pulverizing step may be classified through a classification step in order to obtain toner particles having a volume average particle size in a target range. In the classification step, a centrifugal classifier, an inertia-type classifier or the like, that have been used in the past, is used, and fine particles (toner particles having a particle size smaller than the target range) and coarse particles (toner particles having a particle size larger than the target range) are removed.

External Addition Step

For charging adjustment, endowment of fluidity, endowment of charge exchangeability, and the like, inorganic particles represented by silica, titania and aluminum oxide may be added and attached to the obtained toner particles. This is performed by, for example, a V-blender, a Henschel mixer, a Loedige mixer or the like, and the attachment is performed in stages. The amount the external additive to be added is preferably from 0.1 part by weight to 5 parts by weight, and more preferably from 0.3 part by weight to 2 parts by weight with respect to 100 parts by weight of toner particles.

Sieving Step

If necessary, a sieving step may be provided after the above-described external addition step. Specifically, as a sieving method, for example, a gyro shifter, a vibrating sieving machine, a wind classifier or the like is used. Through sieving, coarse particles of the external additive and the like are removed, and thus the generation of streaks on the photoreceptor and trickling down contamination in the apparatus are prevented.

In this exemplary embodiment, an emulsion aggregating method may be used in which the shape and the particle size of toner particles are easily controlled and the control range in the structure of toner particles such as a core-shell structure is also wide. Hereinafter, a method of manufacturing toner particles using an emulsion aggregating method will be described in detail.

The emulsion aggregating method according to this exemplary embodiment has an emulsification step of forming resin particles (emulsification particles) or the like by emulsifying raw materials of the toner particles, an aggregation step of forming aggregates of the resin particles, and a coalescence step of coalescing the aggregates.

Emulsification Step

A resin particle dispersion may be prepared using a general polymerization method such as an emulsion polymerization method, a suspension polymerization method, or a dispersion polymerization method. Otherwise, a resin particle dispersion may be prepared through emulsification by applying a shear force to a solution obtained by mixing an aqueous medium with a binder resin using a dispersing machine. In this case, particles may be formed by reducing the viscosity of the resin component by heating. In addition, a dispersant may be used in order to stabilize the dispersed resin particles. Furthermore, when a resin is dissolved in an oily solvent having a relatively low solubility to water, the resin is dissolved in the solvent so that particles thereof are dispersed in the water together with a dispersant or a polyelectrolyte, and then heating or decompression is performed to transpire the solvent, thereby preparing a resin particle dispersion.

Examples of the aqueous medium include water such as distilled water and ion exchange water; and alcohols. Water is preferably used.

Examples of the dispersant that is used in the emulsification step include water-soluble polymers such as polyvinyl alcohol, methyl cellulose, ethyl cellulose, hydroxyethyl cellulose, carboxymethyl cellulose, sodium polyacrylate, and sodium polymethacrylate; surfactants such as anionic surfactants, e.g., sodium dodecylbenzenesulfonate, sodium octadecylsulfate, sodium oleate, sodium laurate, and potassium stearate, cationic surfactants, e.g., laurylamine acetate, stearyl amine acetate, and lauryl trimethyl ammonium chloride, zwitterionic surfactants, e.g., lauryl dimethyl amine oxide, and nonionic surfactants, e.g., polyoxyethylene alkyl ether, polyoxyethylene alkyl phenyl ether, and polyoxyethylene alkylamine; and inorganic salts such as tricalcium phosphate, aluminum hydroxide, calcium sulfate, calcium carbonate, and barium carbonate.

Examples of the dispersing machine that is used in the preparation of the emulsified liquid include a homogenizer, a homomixer, a pressure kneader, an extruder, and a media-dispersing machine. The size of the resin particles is preferably 1.0 μm or less, more preferably from 60 nm to 300 nm, and even more preferably from 150 nm to 250 nm in terms of the average particle size (volume average particle size). When the size is 60 nm or greater, the resin particles are easily become unstable in the dispersion, and thus the resin particles may easily aggregate. When the size is 1.0 μm or less, the particle size distribution of the toner may be narrowed.

In the preparation of a release agent dispersion, a release agent is dispersed in water, together with an ionic surfactant or a polyelectrolyte such as a polymer acid or a polymer base, and then a dispersion treatment is performed using a homogenizer or a pressure discharge-type dispersing machine with which a strong shear force is applied thereto, simultaneously with heating to a temperature that is not lower than the melting temperature of the release agent. A release agent dispersion is obtained through such a treatment. In the dispersion treatment, an inorganic compound such as polyaluminum chloride may be added to the dispersion. Examples of the preferable inorganic compound include polyaluminum chloride, aluminum sulfate, highly basic polyaluminum chloride (BAC), polyaluminum hydroxide, and aluminum chloride. Among these, polyaluminum chloride, aluminum sulfate, and the like are preferable.

Through the dispersion treatment, a release agent dispersion containing release agent particles having a volume average particle size of 1 μm or less is obtained. More preferably, the volume average particle size of the release agent particles is from 100 nm to 500 nm.

When the volume average particle size is 100 nm or greater, though there is also an influence of the characteristics of the binder resin to be used, generally, the release agent component is easily incorporated in the toner. When the volume average particle size is 500 nm or less, the release agent in the toner has a superior dispersion state.

In order to prepare a metallic pigment dispersion, a known dispersion method may be used and a general dispersion unit such as a rotary shearing-type homogenizer, a ball mill having media, a sand mill, a Dyno mill, or an Altimizer may be employed, and there are no limits to the dispersion unit. The metallic pigment is dispersed in water, together with an ionic surfactant or a polyelectrolyte such as a polymer acid or a polymer base. The volume average particle size of the dispersed metallic pigment may be 20 μm or less. The volume average particle size is preferably from 3 μm to 16 μm, since the metallic pigment in the toner is dispersed well with no impairment in aggregability.

In addition, a metallic pigment and a binder resin may be dispersed and dissolved to be mixed with each other in a solvent, and dispersed in the water by phase inversion emulsification or shearing emulsification, thereby preparing a dispersion of metallic pigment particles coated with the binder resin.

Aggregation Step

In the aggregation step, a resin particle dispersion, a metallic pigment dispersion, a release agent dispersion, and the like are mixed to prepare a mixture, and heated to a temperature that is not higher than the glass transition temperature of the resin particles to aggregate the resin particles, thereby forming aggregated particles. In many cases, in order to form the aggregated particles, the pH of the mixture is adjusted to acidic under stirring. By virtue of the above stirring conditions, the ratio (C/D) may be adjusted in a preferable range. More specifically, in the aggregated particle forming stage, when rapid stirring and heating are performed, the ratio (C/D) may be reduced, and when the stirring speed is reduced and the heating is performed at lower temperature, the ratio (C/D)

may be increased. The pH is preferably from 2 to 7, at which an aggregating agent may also be effectively used.

Furthermore, in the aggregation step, the release agent dispersion may be added and mixed together with various dispersions such as a resin particle dispersion at once or in several portions.

As the aggregating agent, a di- or higher-valent metal complex is preferably used, as well as a surfactant having an opposite polarity of the polarity of the surfactant that is used as the dispersant, and an inorganic metal salt. Since the amount of the surfactant to be used may be reduced and the charging characteristics are improved, a metal complex is particularly preferably used.

As the inorganic metal salt, aluminum salts and polymers thereof are particularly preferable. In order to obtain a narrower particle size distribution, the valence of the inorganic metal salt is more preferably divalent than monovalent, trivalent than divalent, or tetravalent than trivalent, and further, in the case of the same valences as each other, a polymer-type inorganic metal salt polymer is more suitable.

In this exemplary embodiment, a polymer of tetravalent inorganic metal salt including aluminum is preferably used to obtain a narrow particle size distribution.

In addition, when the aggregated particles have a desired particle size, the resin particle dispersion may be further added (coating step) to prepare a toner having a configuration in which a surface of a core aggregated particle is coated with a resin. In this case, the release agent or the metallic pigment is not easily exposed to the toner surface, and thus the configuration is preferable from the viewpoint of charging properties or developability. In the case of further addition, an aggregating agent may be added or the pH may be adjusted before further addition.

Coalescence Step

In the coalescence step, the progression of the aggregation is stopped by increasing the pH of the suspension of the aggregated particles to a range of from 3 to 9 under stirring conditions based on the aggregation step, and the aggregated particles are coalesced by heating at a temperature that is not lower than the glass transition temperature of the resin.

In addition, in the case of coating with the resin, the resin is also coalesced and the core aggregated particles are coated therewith. Regarding the heating time, the heating may be performed to the extent that the coalescence is caused, and may be performed for from 0.5 hour to 10 hours.

After coalescence, cooling is performed to obtain coalesced particles. In addition, in the cooling step, crystallization may be promoted by lowering the cooling rate at around the glass transition temperature of the resin (glass transition temperature±10° C.), that is, so-called slow cooling.

The coalesced particles obtained by coalescence are subjected to a solid-liquid separation step such as filtration, and if necessary, a washing step and a drying step, and thus toner particles are obtained.

For charging adjustment, endowment of fluidity, endowment of charge exchangeability, and the like, an inorganic oxide as an external additive represented by silica, titania and aluminum oxide is added and attached to the obtained toner particles. A preferable external addition method and a preferable amount of the external additive to be added are as described above.

As well as the above-described inorganic oxide, other components (particles) such as a charge-controlling agent, organic particles, a lubricant, and an abrasive may be added as external additives.

The charge-controlling agent is not particularly limited, but is preferably colorless or light-colored. Examples thereof include a complex of a quaternary ammonium salt compound, a nigrosine compound, aluminum, or chromium, and a triphenylmethane pigment.

Examples of the organic particles include particles that are generally used as an external additive for the toner surface, such as a vinyl resin, a polyester resin, and a silicone resin. These inorganic or organic particles are used as a fluidity aid, and a cleaning aid, and the like.

Examples of the lubricant include fatty acid amides such as ethylene bis stearic acid amide and oleic acid amide, and fatty acid metal salts such as zinc stearate and calcium stearate.

Examples of the abrasive include silica, alumina, and cerium oxide described above.

Next, a method of manufacturing toner particles using a melt and suspension method will be described in detail.

The melt and suspension method is a method of obtaining toner particles including: subjecting a liquid, in which a material containing a binder resin, a metallic pigment, and other optional components such as a release agent is dissolved or dispersed in a solvent in which the binder resin is soluble, to granulation in an inorganic dispersant-containing aqueous medium; and removing the solvent.

Examples of other components that are used in the melt and suspension method include various components such as a charge-controlling agent and organic particles, as well as a release agent.

In this exemplary embodiment, the binder resin, the metallic pigment, and other optional components are dissolved and dispersed in a solvent in which the binder resin is soluble. Whether the binder resin is soluble or not depends on the constituent component of the binder resin, a molecular chain length, a level of three-dimensionalization, and the like, and thus may not be said with certainty, however, hydrocarbons such as toluene, xylene and hexane, halogenated hydrocarbons such as methylene chloride, chloroform, dichloroethane, and dichloroethylene, alcohols or ethers such as ethanol, butanol, benzyl alcohol ethyl ether, benzyl alcohol isopropyl ether, tetrahydrofuran, and tetrahydropyran, esters such as methyl acetate, ethyl acetate, butyl acetate, and isopropyl acetate, and ketones or acetals such as acetone, methyl ethyl ketone, diisobutyl ketone, dimethyl oxide, diacetone alcohol, cyclohexanone, and methylcyclohexanone are generally used.

In these solvents, the binder resin is dissolved and it is not necessary to dissolve the metallic pigment and other components. It is sufficient that the metallic pigment and other components may be dispersed in the binder resin solution. The amount of the solvent to be used is not limited as long as a viscosity at which granulation may be performed in the aqueous medium is provided. The ratio of the material containing a binder resin, a metallic pigment, and other components (the former) to the solvent (the latter) is preferably from 10/90 to 50/50 (the former/the latter in terms of mass ratio) in view of ease of granulation and final yield of toner particles.

The liquid in which the binder resin, the metallic pigment, and other components are dissolved or dispersed in the solvent (toner mother liquid) is granulated so that particles having a predetermined particle size are obtained in the inorganic dispersant-containing aqueous medium. Water is primarily used as the aqueous medium. As the inorganic dispersant, a powder selected from tricalcium phosphate, hydroxyapatite, calcium carbonate, titanium oxide, and silica powders is preferable. The amount of the inorganic dispersant to be used is determined in accordance with the particle size of particles to be granulated. Generally, the amount of the inorganic dispersant to be used is preferably from 0.1% by weight to 15% by weight with respect to the toner mother liquid. When the amount is 0.1% by weight or greater, the granulation is favorably performed, and when the amount is 15% by weight or less, unnecessary fine particles are not easily formed, and thus target particles are easily obtained in good yield.

In order to favorably progress the granulation of the toner mother liquid in the inorganic dispersant-containing aqueous medium, an aid may be added to the aqueous medium. Examples of the aid include known cationic, anionic, and nonionic surfactants, and anionic surfactants are particularly preferable. Examples thereof include sodium alkylbenzene sulfonate, α-sodium olefin sulfonate, and sodium alkylsulfonate. These are used in an amount of preferably from $1\times10^{-4}$% by weight to 0.1% by weight with respect to the toner mother liquid.

The granulation of the toner mother liquid in the inorganic dispersant-containing aqueous medium is preferably performed under shear. The toner mother liquid that is dispersed in the aqueous medium is granulated to have an average particle size of preferably 20 μm or less. The average particle size is particularly preferably from 3 μm to 15 μm.

There are various dispersing machines as an apparatus provided with a shearing mechanism, and among these, a homogenizer is preferable. Using a homogenizer, a substance in a liquid, that is incompatible with the liquid, is dispersed in the form of particles by passing the substances that are incompatible with each other (in this exemplary embodiment, an inorganic dispersant-containing aqueous medium and a toner mother liquid) through a gap between a casing and a rotating rotor. Examples of the homogenizer include a TK homomixer, a line-flow homomixer, an autohomomixer (all manufactured by Tokushukika Kogyo K.K.), a Silverson homogenizer (manufactured by Silverson Machines, Inc.), and a Polytron homogenizer (manufactured by KINEMATICA AG).

The stirring using the homogenizer is preferably performed under the condition that a peripheral velocity of a blade of the rotor is 2 m/sec or higher. When the peripheral velocity is 2 m/sec or higher, there is a tendency that particles are formed favorably. In this exemplary embodiment, the toner mother liquid is granulated in the inorganic dispersant-containing aqueous medium, and then the solvent is removed. The solvent may be removed at room temperature (25° C.) under ordinary pressure. However, since a long time is required until the removal is completed, the solvent is preferably removed at a temperature that is lower than the boiling point of the solvent and has a difference from the boiling point by 80° C. or lower. The pressure may be ordinary or reduced. When the pressure is reduced, the pressure is preferably from 20 mmHg to 150 mmHg.

The toner according to this exemplary embodiment is preferably washed with a hydrochloric acid or the like after removal of the solvent. Accordingly, the inorganic dispersant remaining on the surfaces of the toner particles is removed, and thus characteristics may be improved with the original composition of the toner particles. When performing dehydration and drying, powdery toner particles may be obtained.

As in the case of the emulsion aggregating method, for charging adjustment, endowment of fluidity, endowment of charge exchangeability, and the like, an inorganic oxide as an external additive represented by silica, titania and aluminum oxide is added and attached to the toner particles obtained by the melt and suspension method. As well as the above-described inorganic oxide, other components (particles) such as a charge-controlling agent, organic particles, a lubricant, and an abrasive may be added as external additives.

Electrostatic Charge Image Developer

An electrostatic charge image developer according to this exemplary embodiment includes at least the toner according to this exemplary embodiment.

The electrostatic charge image developer according to this exemplary embodiment may be a single-component developer including only the toner according to this exemplary embodiment, or a two-component developer obtained by mixing the toner with a carrier.

The carrier is not particularly limited, and known carriers are exemplified. Examples of the carrier include a coating carrier in which surfaces of cores formed of a magnetic powder are coated with a coating resin; a magnetic powder dispersion-type carrier in which a magnetic powder is dispersed and blended in a matrix resin; a resin impregnation-type carrier in which a porous magnetic powder is impregnated with a resin; and a resin dispersion-type carrier in which conductive particles are dispersed and blended in a matrix resin.

The magnetic powder dispersion-type carrier, the resin impregnation-type carrier, and the conductive particle dispersion-type carrier may be carriers in which constituent particles of the carrier are cores and coated with a coating resin.

Examples of the magnetic powder include magnetic metals such as iron oxide, nickel, and cobalt, and magnetic oxides such as ferrite and magnetite.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as a conductive material.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (mass ratio) between the toner and the carrier in the two-component developer is preferably from 1:100 to 30:100 (toner:carrier), and more preferably from 3:100 to 20:100.

Image Forming Apparatus and Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer to form a toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including a charging step of charging a surface of an image holding member, an electrostatic charge image forming step of forming an electrostatic charge image on a charged surface of the image holding member, a developing step of developing the electrostatic charge image formed on the surface of the image holding member with the electrostatic charge image developer according to this exemplary embodiment to form a toner image, a transfer step of transferring the toner image formed on the surface of the image holding member onto a surface of a recording medium, and a fixing step of fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning unit that cleans, after transfer of a toner image and before charging, a surface of an image holding member; or an apparatus that is provided with an erasing unit that irradiates, after transfer of a toner image and before charging, a surface of an image holding member with erasing light for erasing.

In the case of an intermediate transfer-type apparatus, a transfer unit is configured to have, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that accommodates the electrostatic charge image developer according to this exemplary embodiment and is provided with a developing unit is preferably used.

Hereinafter, an example of the image forming apparatus according to this exemplary embodiment will be shown. However, this image forming apparatus is not limited thereto. Major parts shown in the drawings will be described, but descriptions of other parts will be omitted.

Figure 4:
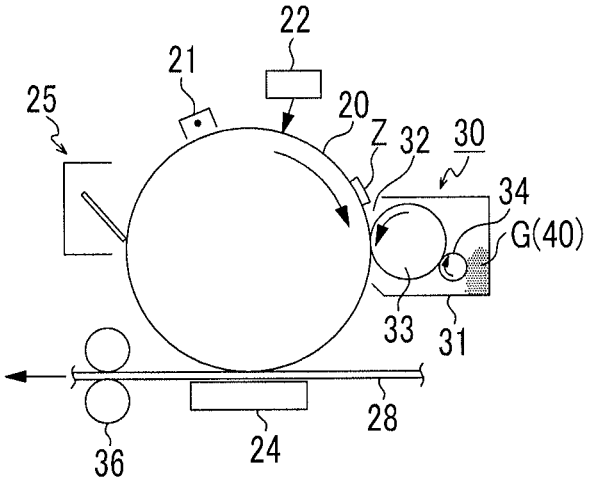
FIG. 4 is a schematic diagram showing a configuration of an image forming apparatus to which the exemplary embodiment is applied.

FIG. 4 is a schematic diagram showing a configuration of an exemplary embodiment of an image forming apparatus including a developing device to which the electrostatic charge image developer according to this exemplary embodiment is applied.

In FIG. 4, the image forming apparatus according to this exemplary embodiment has a photoreceptor drum 20 as an image holding member rotating in a predetermined direction. A charging device 21 that charges the photoreceptor drum 20, an exposure device 22 as an electrostatic charge image forming device that forms an electrostatic charge image Z on the photoreceptor drum 20, a developing device 30 that visualizes the electrostatic charge image Z formed on the photoreceptor drum 20, a transfer device 24 that transfers the toner image visualized on the photoreceptor drum 20 onto a recording sheet 28 as a recording medium, and a cleaning device 25 that cleans the toner remaining on the photoreceptor drum 20 are arranged in sequence around the photoreceptor drum 20.

In this exemplary embodiment, as shown in FIG. 4, the developing device 30 has a developing housing 31 that contains a developer G including a toner 40. This developing housing 31 has a developing opening 32 formed to be opposed to the photoreceptor drum 20, and a developing roll (developing electrode) 33 as a toner holding member arranged to face the developing opening 32. When a predetermined developing bias is applied to the developing roll 33, a developing electric field is formed in a region (developing region) sandwiched between the photoreceptor drum 20 and the developing roll 33. In the developing housing 31, a charge injection roll (injection electrode) 34 as a charge injection member is provided to be opposed to the developing roll 33. Particularly, in this exemplary embodiment, the charge injection roll 34 also acts as a toner supply roll for supplying the toner 40 to the developing roll 33.

Herein, the charge injection roll 34 may be rotated in an arbitrarily selected direction, but in consideration of supply properties of the toner and charge injection properties, it is preferable that the charge injection roll 34 be rotated in the same direction as that of the developing roll 33 at a part opposed to the developing roll 33 with a difference in the peripheral velocity (for example, 1.5 times or grater), and the toner 40 be held in a region sandwiched between the charge injection roll 34 and the developing roll 33 and rubbed to inject charges.

Next, an operation of the image forming apparatus according to the exemplary embodiment will be described.

When an image forming process is started, first, the surface of the photoreceptor drum 20 is charged by the charging device 21, the exposure device 22 records an electrostatic charge image Z on the charged photoreceptor drum 20, and the developing device 30 visualizes the electrostatic charge image Z as a toner image. Then, the toner image on the photoreceptor drum 20 is transported to a transfer site, and the transfer device 24 electrostatically transfers the toner image on the photoreceptor drum 20 onto a recording sheet 28 as a recording medium. The toner remaining on the photoreceptor drum 20 is cleaned by the cleaning device 25. Thereafter, the toner image on the recording sheet 28 is fixed by a fixing device 36 to obtain an image.

Process Cartridge and Toner Cartridge

Figure 5:
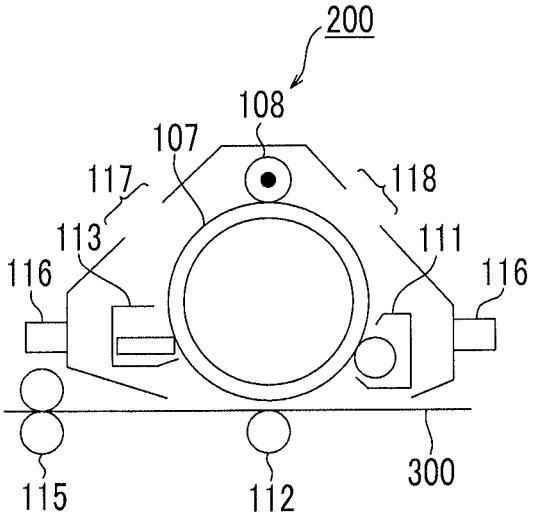
FIG. 5 is a schematic diagram showing a configuration of an example of a process cartridge according to the exemplary embodiment.

FIG. 5 is a schematic diagram showing a configuration of an example of a process cartridge according to this exemplary embodiment. The process cartridge according to this exemplary embodiment may be configured to be provided with a developing unit that accommodates the electrostatic charge image developer according to this exemplary embodiment and develops an electrostatic charge image formed on a surface of an image holding member with the electrostatic charge image developer to form a toner image, and configured to be detachable from an image forming apparatus.

The process cartridge 200 shown in FIG. 5 has, in addition to a photoreceptor 107 as an image holding member, a charging roller 108, a developing device 111 that contains the electrostatic charge image developer according to this exemplary embodiment, a photoreceptor cleaning device 113, an opening 118 for exposure, and an opening 117 for erasing exposure, and they are combined and integrated using an attachment rail 116. The process cartridge 200 is detachable from a main body of an image forming apparatus constituted by a transfer device 112, a fixing device 115, and other constituent parts (not shown), and constitutes the image forming apparatus together with the main body of the image forming apparatus. In FIG. 5, the reference numeral 300 represents a recording medium.

The process cartridge 200 shown in FIG. 5 is provided with the photoreceptor 107, the charging roller 108, the developing device 111, the cleaning device 113, the opening 118 for exposure, and the opening 117 for erasing exposure, but these devices may be selectively combined. The process cartridge according to this exemplary embodiment is provided with, as well as the developing device 111, at least one selected from the group consisting of the photoreceptor 107, the charging roller 108, the cleaning device (cleaning unit) 113, the opening 118 for exposure, and the opening 117 for erasing exposure.

Next, a toner cartridge according to this exemplary embodiment will be described. The toner cartridge according to this exemplary embodiment may be configured to accommodate the brilliant toner according to this exemplary embodiment and to be detachable from an image forming apparatus. In the toner cartridge according to this exemplary embodiment, it is sufficient that at least a toner may be accommodated, or for example, a developer may be accommodated in accordance with the mechanism of the image forming apparatus.

The image forming apparatus shown in FIG. 4 has a configuration from which a toner cartridge (not shown) is detachable, and the developing device 30 is connected to the toner cartridge via a toner supply tube (not shown). In addition, when the toner accommodated in the toner cartridge runs low, the toner cartridge may be replaced.

EXAMPLES

Hereinafter, this exemplary embodiment will be described in more detail using examples and comparative examples, but is not limited to the following examples. Unless specifically noted, "parts" and "%" are based on the weight.

Measurement of Fe Content (Content of Fe) by XRF

A disk having a diameter of 5 cm is prepared by applying a compression pressure of 10 ton to 5 g of a toner by using a pressure molding machine, and is set as a measurement sample. Using a X-ray fluorescence spectrometer (XRF-1500) manufactured by Shimadzu Corporation, the disk is subjected to the measurement under measurement conditions of a tube voltage of 40 KV, a tube current of 90 mA, and a measurement time of 30 minutes.

Measurement of Fe Content (Content of Fe in Surface) in Toner Surface by XPS

JPS-9000MX manufactured by JEOL Ltd. is used as a measuring device, and the measurement is performed using MgKα-rays as an X-ray source at an accelerating voltage of 10 kV and an emission current of 30 mA.

Preparation of Metallic Pigment 1

Aluminum Pigment (manufactured by Showa Aluminum Corporation, 2173EA): 100 parts 10% Iron Chloride Aqueous Solution: 5,000 parts The above components are mixed and stirred for 30 seconds to uniformly attach iron chloride to surfaces of metallic pigment particles. The obtained material is filtered, and then vacuum-dried, thereby obtaining an iron-coated metallic pigment 1.

Preparation of Metallic Pigment Dispersion 1

Metallic Pigment 1: 100 parts

Anionic Surfactant (manufactured by Dai-Ichi Kogyo Seiyaku Co., Ltd., Neogen R): 1.5 parts Ion Exchange Water: 900 parts The above components are mixed and dispersed for about 1 hour using an emulsification dispersing machine Cavitron (manufactured by Pacific Machinery & Engineering Co., Ltd., CR1010), thereby preparing a metallic pigment dispersion 1 (solid content concentration: 10%) in which metallic pigment particles are dispersed.

Preparation of Metallic Pigment 2 and Metallic Pigment Dispersion 2

A metallic pigment 2 is obtained in the same manner as in the case of the metallic pigment 1, except that the stirring time is set to 10 minutes.

A metallic pigment dispersion 2 is prepared in the same manner as in the case of the preparation of the metallic pigment dispersion 1, except that the metallic pigment 2 is used in place of the metallic pigment 1.

Preparation of Metallic Pigment 3 and Metallic Pigment Dispersion 3

A metallic pigment 3 is obtained in the same manner as in the case of the metallic pigment 1, except that the stirring time is set to 10 seconds.

A metallic pigment dispersion 3 is prepared in the same manner as in the case of the preparation of the metallic pigment dispersion 1, except that the metallic pigment 3 is used in place of the metallic pigment 1.

Preparation of Metallic Pigment 4 and Metallic Pigment Dispersion 4

Aluminum: 99.95 parts

Iron: 0.05 part

The above components are mixed to prepare a hot metal. Next, a powder is manufactured using the hot metal under the application of an air atomizing method, and then the powder is subjected to a classification treatment, thereby obtaining a metallic pigment 4.

A metallic pigment dispersion 4 is prepared in the same manner as in the case of the preparation of the metallic pigment dispersion 1, except that the metallic pigment 4 is used in place of the metallic pigment 1.

Preparation of Metallic Pigment Dispersion 5

Aluminum Pigment (manufactured by Showa Aluminum Corporation, 2173EA): 100 parts Anionic Surfactant (manufactured by Dai-Ichi Kogyo Seiyaku Co., Ltd., Neogen R): 1.5 parts Ion Exchange Water: 900 parts The above components are mixed after removing a solvent from an aluminum pigment paste, and dispersed for about 1 hour using an emulsification dispersing machine Cavitron (manufactured by Pacific Machinery & Engineering Co., Ltd., CR1010), thereby preparing a metallic pigment dispersion 5 (solid content concentration: 10%) in which metallic pigment particles (aluminum pigment) are dispersed.

Preparation of Metallic Pigment 6 and Metallic Pigment Dispersion 6

A metallic pigment 6 is obtained in the same manner as in the case of the metallic pigment 1, except that the concentration of the iron chloride aqueous solution is set to 25% and the stirring time is set to 20 minutes.

A metallic pigment dispersion 6 is prepared in the same manner as in the case of the preparation of the metallic pigment dispersion 1, except that the metallic pigment 6 is used in place of the metallic pigment 1.

Preparation of Metallic Pigment 7 and Metallic Pigment Dispersion 7

A metallic pigment 7 is obtained in the same manner as in the case of the metallic pigment 1, except that the concentration of the iron chloride aqueous solution is set to 5% and the stirring time is set to 10 seconds.

A metallic pigment dispersion 7 is prepared in the same manner as in the case of the preparation of the metallic pigment dispersion 1, except that the metallic pigment 7 is used in place of the metallic pigment 1.

Synthesis of Binder Resin

Dimethyl Adipate: 74 parts

Dimethyl Terephthalate: 192 parts

Ethylene Oxide Adduct of Bisphenol A: 216 parts

Ethylene Glycol: 38 parts

Tetrabutoxy Titanate (catalyst): 0.037 part

The above components are put into a heat-dried two-necked flask, and the temperature is increased while the components are stirred in an inert atmosphere with a nitrogen gas supplied to the container. Then, the obtained material is subjected to a co-condensation polymerization reaction for 7 hours at 160° C., and then while the pressure is slowly reduced to 10 Torr, the temperature is increased to 220° C. and the material is held for 4 hours. The pressure is returned to the ordinary pressure, and 9 parts of trimellitic anhydride is added. The pressure is slowly reduced again to 10 Torr, and the material is held for 1 hour at 220° C., whereby a binder resin is synthesized.

The glass transition temperature (Tg) of the binder resin is obtained through the measurement under the condition of a rate of temperature increase of 10° C./min from room temperature (25° C.) to 150° C. by using a differential scanning calorimeter (manufactured by Shimadzu Corporation: DSC-50) on the basis of ASTMD3418-8. A temperature at an intersection point between extended lines of the base line and the rising line in the heat-absorbing part is set as the glass transition temperature. The glass transition temperature of the binder resin is 63.5° C.

Preparation of Resin Particle Dispersion

Binder Resin: 160 parts

Ethyl Acetate: 233 parts

Sodium Hydroxide Aqueous Solution (0.3 N): 0.1 part

The above components are put into a 1,000 ml separable flask, heated at 70° C., and stirred using a three-one motor (manufactured by Shinto Scientific Co., Ltd.) to prepare a resin mixture. During further stirring of this resin mixture at 90 rpm, 373 parts of ion exchange water is slowly added thereto to perform phase inversion emulsification, and the solvent is removed. Thus, a resin particle dispersion (solid content concentration: 30%) is obtained. The volume average particle size of the resin particle dispersion is 162 nm.

Preparation of Release Agent Dispersion

Carnauba Wax (manufactured by Toa Kasei Co., Ltd., RC-160): 50 parts

Anionic Surfactant (manufactured by Dai-Ichi Kogyo Seiyaku Co., Ltd., Neogen RK): 1.0 part Ion Exchange Water: 200 parts The above components are mixed and heated at 95° C. and the mixture is dispersed using a homogenizer (manufactured by IKA-Werke GmbH & Co. KG, Ultra Turrax T50). Then, a dispersion treatment is performed for 360 minutes using a Manton Gaulin high-pressure homogenizer (manufactured by Gaulin Corporation) to prepare a release agent dispersion (solid content concentration: 20%) in which release agent particles having a volume average particle size of 0.23 μm are dispersed.

Example 1

Preparation of Toner

Resin Particle Dispersion: 450 parts

Release Agent Dispersion: 50 parts

Metallic Pigment Dispersion 1: 21.74 parts

Nonionic Surfactant (IGEPAL CA897): 1.40 parts

The above raw materials are put into a 2 L cylindrical stainless-steel container, and dispersed and mixed for 10 minutes using a homogenizer (manufactured by Ika-werke gmbh & co. kg, Ultra Turrax T50) at 4,000 rpm while applying a shear force. Next, 1.75 parts of a 10% nitric acid aqueous solution of polyaluminum chloride is slowly added dropwise as an aggregating agent to the mixture, and the mixture is dispersed and mixed for 15 minutes at a number of revolutions of the homogenizer of 5,000 rpm. Thus, a raw material dispersion is prepared.

Thereafter, the raw material dispersion is transferred to a polymerization vessel provided with a thermometer and a stirrer having a stirring blade having two paddles for forming a laminar flow. Heating is started by a mantle heater at a number of stirring revolutions of 810 rpm to promote the growth of aggregated particles at 54° C. In this case, the pH of the raw material dispersion is controlled to from 2.2 to 3.5 with a 0.3 N nitric acid or a 1N sodium hydroxide aqueous solution. The raw material dispersion is maintained for about 2 hours at a pH in the above range to form aggregated particles.

Next, 100 parts of the resin particle dispersion is further added thereto to attach the resin particles of the binder resin to surfaces of the aggregated particles. The temperature is further increased to 56° C., and the aggregated particles are aligned while the size and the form of the particles are confirmed with an optical microscope and a Multisizer II. Thereafter, in order to cause the aggregated particles to coalesce, the pH is increased to 8.0, and then the temperature is increased to 67.5° C. After the coalescence of the aggregated particles is confirmed with the optical microscope, the pH is decreased to 6.0 while the temperature is maintained at 67.5° C. After 1 hour, the heating is stopped and the particles are cooled at a rate of temperature decrease of 1.0° C./min. Thereafter, the particles are sieved through a 20 μm mesh, repeatedly washed with water, and then dried by a vacuum dryer, thereby obtaining toner particles. The volume average particle size of the obtained toner particles is 12.2 μm.

2.0 parts of hydrophobic silica (manufactured by Nippon Aerosil Co., Ltd., RY50) is mixed with 100 parts of the obtained toner particles using a Henschel mixer at a peripheral velocity of 30 m/s for 3 minutes. Thereafter, the mixture is sieved through a vibrating screen having openings of 45 μm to prepare a toner.

Measurement

The "content of Fe" and the "Content of Fe in Surface" are measured by the above-described methods, respectively. The results thereof are shown in the following Table 1.

Preparation of Carrier

Ferrite Particles (volume average particle size: 35 μm): 100 parts

Toluene: 14 parts

Perfluoroacrylate Copolymer (critical surface tension: 24 dyn/cm): 1.6 parts

Carbon Black (trade name: VXC-72, manufactured by Cabot Corporation, volume resistivity: 100 Ωcm or less): 0.12 part Crosslinked Melamine Resin Particles (average particle size: 0.3 μm, insoluble in toluene): 0.3 part First, the carbon black is diluted with the toluene, and the obtained material is added to the perfluoroacrylate copolymer. The mixture is dispersed using a sand mill. Next, the above components except for the ferrite particles are dispersed with a stirrer for 10 minutes to prepare a coating layer forming solution. Next, the coating layer forming solution and the ferrite particles are put into a vacuum deaeration-type kneader and stirred for 30 minutes at a temperature of 60° C., and then the toluene is distilled away under reduced pressure to form a resin coating layer, thereby obtaining a carrier.

Preparation of Developer 36 parts of the toner and 414 parts of the carrier are put into a 2 L V-blender, and stirred for 20 minutes. Thereafter, the obtained material is sieved through a 212-μm mesh to prepare a developer.

Evaluation Tests

A solid image is formed by the following method.

A developing device of a DocuCentre-III C7600 manufactured by Fuji Xerox Co., Ltd. is filled with a developer that is a sample, and a solid image with a toner amount of 4.5 g/cm$^2$ is formed on a recording sheet (rough paper, manufactured by Oji Paper Co., Ltd.) at a fixing temperature of 200° C., a fixing pressure of 4.0 kg/cm$^2$, and a process speed of 220 mm/s.

The solid image is stored for 6 months under the environment of 40° C. and a humidity of 85% to evaluate brilliance by image discoloration.

Evaluation of Brilliance

The brilliance is visually evaluated under illumination for color observation (natural daylight illumination) based on "testing methods for paints, Part 4: visual characteristics of film, Section 3: visual comparison of the color of paints" in JIS K5600-4-3: 1999. A particle feeling (shining brilliance effect) and an optical effect (change in the hue depending on the angle of view) are evaluated with the following standards. Level 2 or higher levels are judged practically usable level.

5: The particle feeling and the optical effect are harmonized.

4: The particle feeling and the optical effect are slightly observed.

3: Normal feeling.

2: There is a blurred feeling.

1: There are no particle feeling and no optical effect.

The obtained evaluation results are shown in Table 1.

Example 2

A toner is prepared in the same manner as in Example 1, except that the metallic pigment dispersion 1 is changed to the metallic pigment dispersion 2. A developer is prepared in the same manner as in Example 1 by using the obtained toner, and a solid image is formed. The formed image is stored for 6 months under the environment of 40° C. and a humidity of 85%, and then brilliance is evaluated.

The obtained evaluation result is shown in Table 1.

Example 3

A toner is prepared in the same manner as in Example 1, except that the metallic pigment dispersion 1 is changed to the metallic pigment dispersion 3. A developer is prepared in the same manner as in Example 1 by using the obtained toner, and a solid image is formed. The formed image is stored for 6 months under the environment of 40° C. and a humidity of 85%, and then brilliance is evaluated.

The obtained evaluation result is shown in Table 1.

Example 4

A toner is prepared in the same manner as in Example 1, except that the metallic pigment dispersion 1 is changed to the metallic pigment dispersion 4 and the aggregating agent is changed to 1.70 parts of a 1% iron chloride aqueous solution. A developer is prepared in the same manner as in Example 1 by using the obtained toner, and a solid image is formed. The formed image is stored for 6 months under the environment of 40° C. and a humidity of 85%, and then brilliance is evaluated.

The obtained evaluation result is shown in Table 1.

Example 5

A toner is prepared in the same manner as in Example 4, except that after sieving, water washing is performed with water 10 times the normal amount. A developer is prepared in the same manner as in Example 4 by using the obtained toner, and a solid image is formed. The formed image is stored for 6 months under the environment of 40° C. and a humidity of 85%, and then brilliance is evaluated.

The obtained evaluation result is shown in Table 1.

Example 6

A toner is prepared in the same manner as in Example 4, except that a step of adding 1.70 parts of a 1% iron chloride aqueous solution when 100 parts of a resin particle dispersion is further added is added. A developer is prepared in the same manner as in Example 4 by using the obtained toner, and a solid image is formed. The formed image is stored for 6 months under the environment of 40° C. and a humidity of 85%, and then brilliance is evaluated.

The obtained evaluation result is shown in Table 1.

Example 7

A toner is prepared in the same manner as in Example 1, except that the metallic pigment dispersion 1 is changed to the metallic pigment dispersion 5. A developer is prepared in the same manner as in Example 1 by using the obtained toner, and a solid image is formed. The formed image is stored for 6 months under the environment of 40° C. and a humidity of 85%, and then brilliance is evaluated.

The obtained evaluation result is shown in Table 1.

Example 8

Binder Resin: 450 parts

Carnauba Wax: 50 parts

Metallic Pigment 1: 5.5 parts

The above components are weighed, and then mixed using a powder mixer such as a ball mill. The obtained mixture is kneaded at 190° C. using a screw extruder. After completion of the kneading, the obtained kneaded material is cooled using a mill roll. The kneaded material is coarsely pulverized using a hammer mill, and further finely pulverized using a jet mill. After completion of the fine pulverization, classification is performed by an Elbow-Jet classifier to obtain toner particles.

Using the obtained toner particles, external addition is performed in the same manner as in Example 1, a developer is prepared, and a solid image is formed. The formed image is stored for 6 months under the environment of 40° C. and a humidity of 85%, and then brilliance is evaluated.

The obtained evaluation result is shown in Table 1.

Comparative Example 1

A toner is prepared in the same manner as in Example 1, except that the metallic pigment dispersion 1 is changed to the metallic pigment dispersion 6. A developer is prepared in the same manner as in Example 1 by using the obtained toner, and a solid image is formed. The formed image is stored for 6 months under the environment of 40° C. and a humidity of 85%, and then brilliance is evaluated.

The obtained evaluation result is shown in Table 1.

Comparative Example 2

A toner is prepared in the same manner as in Example 1, except that the metallic pigment dispersion 1 is changed to the metallic pigment dispersion 7. A developer is prepared in the same manner as in Example 1 by using the obtained toner, and a solid image is formed. The formed image is stored for 6 months under the environment of 40° C. and a humidity of 85%, and then brilliance is evaluated.

The obtained evaluation results are shown in Table 1.

TABLE 1

| Examples | Fe Content (%) | Fe Content in Surface (%) | Evaluation |
|---|---|---|---|
| Example 1 | 0.052 | 0.030 | 5 |
| Example 2 | 1.950 | 1.170 | 4 |
| Example 3 | 0.001 | 0.0008 | 4 |
| Example 4 | 0.023 | 0.0002 | 3 |
| Example 5 | 0.045 | 4.125 | 3 |
| Example 6 | 0.050 | 0.032 | 5 |
| Example 7 | 0.045 | 0.040 | 5 |
| Example 8 | 0.026 | 0.015 | 2 |
| Comparative Example 1 | 8.100 | 4.930 | 1 |
| Comparative Example 2 | 0.0001 | 0.00008 | 1 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A brilliant toner comprising:

a binder resin; and a metallic pigment that contains metallic Al, wherein a Fe content in the brilliant toner is from 0.001% by weight to 2% by weight with respect to a total weight of the brilliant toner, wherein a Fe content in a surface of the brilliant toner that is measured by an X-ray photoelectron spectrometer (XPS) is from 0.0005% by weight to 2% by weight, and wherein the Fe content by weight in the surface of the brilliant toner is less than the Fe content in the brilliant toner.

2. The brilliant toner according to claim 1, wherein the metallic pigment further contains Fe.

3. The brilliant toner according to claim 1, wherein a surface of the metallic pigment is coated with a Fe-containing layer.

4. The brilliant toner according to claim 1, wherein when a solid image is formed on a recording medium using the brilliant toner, a ratio (A/B) of a reflectance A at a light-receiving angle of +30° to a reflectance B at a light-receiving angle of −30°, that are measured when the image is irradiated with incident light at an incident angle of −45° by a goniophotometer, is from 2 to 100.

5. The brilliant toner according to claim 4, wherein an average equivalent circle diameter D of the brilliant toner is longer than an average maximum thickness C of the toner.

6. The brilliant toner according to claim 4, wherein when a cross section of the brilliant toner in a thickness direction is observed, the number of metallic pigment particles that are present so that an angle between a long axis direction of the toner in the cross section and a long axis direction of the metallic pigment is from −30° to +30° is 60% or greater of the total number of metallic pigment particles that are observed.

7. The brilliant toner according to claim 1, further comprising:

a polyester resin as the binder resin.

8. The brilliant toner according to claim 7, wherein a weight-average molecular weight (Mw) of the polyester resin is from 5,000 to 1,000,000.

9. The brilliant toner according to claim 7, wherein a molecular weight distribution Mw/Mn of the polyester resin is from 1.5 to 100.

10. The brilliant toner according to claim 1, further comprising:

a release agent, wherein a melting temperature of the release agent is from 50° C. to 110° C.

11. The brilliant toner according to claim 1, wherein a volume average particle size is from 1 μm to 30 μm.

12. The brilliant toner according to claim 2, wherein a Fe in the metallic pigment is from 0% by weight to 5% by weight with respect to a content of Al in the metallic pigment.

13. The brilliant toner according to claim 1, wherein a Fe content in the brilliant toner is from 0.001% by weight to 0.05% by weight with respect to the total weight of the brilliant toner.

14. An electrostatic charge image developer comprising:

the brilliant toner according to claim 1.

15. A toner cartridge that accommodates the brilliant toner according to claim 1 and is detachable from an image forming apparatus.

* * * * *